169-46 SR
5/30/78 OR 4,091,874

United States Patent [19]
Monma

[11] 4,091,874
[45] May 30, 1978

[54] FIRE EXTINGUISHING METHOD AND SYSTEM FOR LARGE BUILDINGS

[76] Inventor: Kodo Monma, Tokyo, Japan

[21] Appl. No.: 669,081

[22] Filed: Mar. 22, 1976

[30] Foreign Application Priority Data

June 16, 1975 Japan ..... 50/72046

[51] Int. Cl.[2] ..... A62C 1/02; A62C 3/00; A62C 35/00

[52] U.S. Cl. ..... 169/46; 169/61; 169/5

[58] Field of Search ..... 169/43-50, 169/54, 56, 60, 61, 70, 14, 15, 23; 98/33 R, 42, 43; 236/49

[56] References Cited

U.S. PATENT DOCUMENTS

| | | | |
|---|---|---|---|
| 2,586,797 | 2/1952 | Dunlop et al. | 169/48 |
| 2,609,743 | 9/1952 | Ashley et al. | 98/33 R |
| 3,227,219 | 1/1966 | Boyer et al. | 169/23 |
| 3,252,400 | 5/1966 | Madl, Jr. | 98/33 R X |
| 3,739,707 | 6/1973 | Knapp | 236/49 X |
| 3,884,133 | 5/1975 | Miller | 169/61 X |
| 3,893,514 | 7/1975 | Carhart et al. | 169/46 |
| 3,926,101 | 12/1975 | Moss | 169/60 X |
| 3,979,326 | 9/1976 | Chatterton | 169/14 X |

*Primary Examiner*—Evon C. Blunk
*Assistant Examiner*—Andres Kashnikow
*Attorney, Agent, or Firm*—Otto John Munz

[57] ABSTRACT

A method and system for extinguishing fires in large buildings containing a plurality of fire fighting sections wherein a fire occurring in any of the fire fighting sections is detected to signal a central control panel which produces a warning in that section indicating to occupants that they should quickly leave, the fire fighting section in which the fire occurred being shut tight by fire doors or the like a predetermined time after the warning is provided and after the occupants have escaped. Once the fire fighting section in which the fire has broken out is isolated or shut tight, the flame, smoke and air are evacuated from the fire fighting section via a suction system positioned adjacent the floor of the fire fighting section while a fire extinguishing agent is injected into the fire fighting section from a position adjacent the ceiling such that the fire extinguishing agent is evenly distributed throughout the fire fighting section over articles therein due to the draw created by the evacuation from a position adjacent the floor.

10 Claims, 5 Drawing Figures

FIRE EXTINGUISHING METHOD AND SYSTEM FOR LARGE BUILDINGS

BACKGROUND OF THE INVENTION

The present invention relates to a method and system for promptly extinguishing fires in large buildings, such as skyscrapers.

Various laws and regulations exist relative to the extinguishing of fires and the escape of occupants of skyscrapers when a fire has started therein in order to save lives and prevent damage, such regulations seeking to prevent spread of fire in floors of a skyscraper above the floor in which a fire has started and providing wintermeasures against smoke and flame and means of escape for occupants. For the stories of a skyscraper higher than 30 m. above the ground, water spreading sprinklers must be arranged in order to prevent fire in such high stories in the skyscraper. However, no effective measures for positively preventing fire spreading in a skyscraper have been proposed.

The problem of promptly extinguishing fires in skyscrapers has been increasing recently in that the number of stories in skyscrapers has increased to several tens of stories.

SUMMARY OF THE INVENTION

The object of the present invention is to provide a novel and useful method for promptly extinguishing fire occuring in a skyscraper.

Another object is to provide a novel and useful system for carrying out the method of extinguishing fires of the present invention.

The method of the present invention includes the steps of substantially completely shutting tight one of the fire fighting sections formed in a skyscraper including the zone in which a fire has started immediately after occupants of the fire fighting section have escaped therefrom, evacuating flame, smoke and air from the fire fighting section and injecting a fire extinguishing agent into the section to thereby promptly extinguish the fire.

In accordance with one feature of the present invention, the fire extinguishing agent may be a liquefied inert gas, such as liquefied nitrogen, or a bubble or foamable fire extinguishing liquid. When liquefied nitrogen is used as the fire extinguishing agent, the atmosphere in the fire fighting section is promptly made short of oxygen to starve the fire while the temperature in the section is promptly lowered below the flashing point of combustibles in the section. After replacing the atmosphere in the section by fresh open air once the fire has been extinguished, there are no harmful effects to articles in the section as might occur when sprinklers are used due to the fact that liquefied nitrogen leaves no contaminant on the articles after gasification thereof.

In accordance with the present invention, the evacuation of flame, smoke and air from the section in which a fire has occurred is effected at a low location, preferably at a plurality of low locations spaced from each other in the section, while the injecting of a fire extinguishing agent is effected at a high location above the level of evacuation. Preferably at a plurality of higher locations spaced from each other in the section, so that a uniform and effective distribution of the fire extinguishing agent in the section is insured by virtue of the evacuation of flame, smoke and air.

The system for carrying out the above method according to the present invention includes an overall control panel provided in a central control station in the skyscraper to which detecting means for detecting occurrence of fire in any of the fire fighting sections is connected. The control panel, upon receiving a signal from the detecting means, automatically issues demands in predetermined time sequence to closure means for the fire fighting section in which fire has taken place, suction means in that section and injection means in that section for the operation thereof, thereby permitting centralized automatic control for extinguishing fires.

A warning is issued from the control panel only to the story including the section in which fire has broken out upon receipt of the signal from the detecting means in order to prevent panic of occupants of other stories and to prevent the utter confusion which might be caused if all the occupants in the skyscraper received warning at the time of occurrence of a fire in only one section.

DETAILED DESCRIPTION OF THE PREFERRED EMBODIMENT

Figure 1:
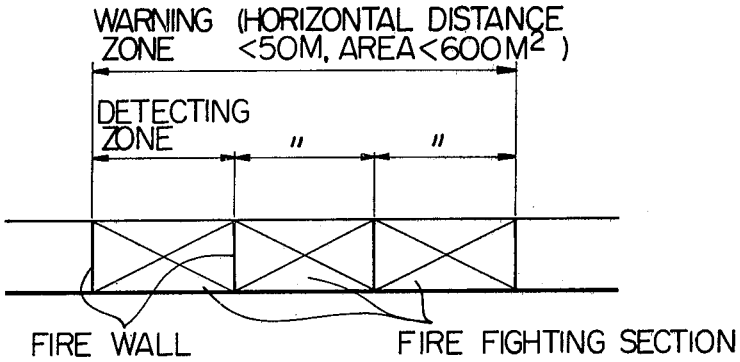
FIG. 1 is a schematic view showing an example of arrangement of fire prevention zones in a warning section or zone in a skyscraper in accordance with the present invention.

In accordance with the present invention, each story of a skyscraper to which the present invention is applied is provided with fire prevention sections or zones as shown in FIG. 1 at the time the skyscraper is designed in order to most effectively and positively effect the extinguishing of fires.

As shown in FIG. 1, a plurality of detecting zones having sensing means for detecting the occurrence of fire are arranged in each of the warning zones. Fire fighting sections, each correspoding to a detecting zone, are formed by closure means or fire prevention doors.

An overall control panel is arranged in a central control station in the skyscraper in order to automatically and sequentially control the escape of occupants, and the prompt extinguishing of a fire by programming the operations by computer means provided in the overall control panel, as described later, therby permitting centralization of the automatic fire control system.

In accordance with the present invention, the escape of occupants from a fire fighting section in which a fire has broken out must be completed before flash over of fire takes place. To this end, the time for occupants to leave the section is set at 30 sec. after detection of fire by the sensing means, and the arrangement of the fire fighting sections is such that the occupants can easily escape from the section within 30 sec. Flash over of the fire to adjacent sections is positively prevented after all the occupants have escaped from the section in which fire has taken place, noxious gases and flames being prevented from entering adjacent sections by closure means substantially shutting tight the section in which fire has broken out operated by the overall control panel while harm to the occupants is prevented.

Suction means, such as a bellmouthed suction funnel, preferably a plurality of suction funnels spaced from each other, is provided in the floor of each of the fire fighting sections in order to rapidly evacuate the atmosphere in the section in which a fire has started. The suction means may be connected to a large capacity suction pump disposed at a lower portion of the building through suction ducts, and the suction means is actuated by electromagnetic valves controlled by the control panel so that evacuated noxious gases are promptly removed from the section through a noxious gas neutralizing reservoir.

Injecting means, such as an injecting nozzle, preferably a plurality of injecting nozzles spaced from each other, is provided in the ceiling of each of the fire fighting section, and the injection means are connected through supply conduits and, if necessary, through supply pumps controlled by the control panel with a reservoir of fire extinguishing agent, such as liquefied nitrogen or bubble or foamable fire extinguishing liquid arranged on the roof of the building for example, so that the fire extinguishing agent is injected in an atomized state in the section in which a fire has started by the action of electromagnetic valves provided for the nozzles.

Warning means is also provided and is actuated by the control panel upon detection of fire by the detecting or sensing means. The warning means preferably issues a warning only to the occupants in the story or floor including the section in which fire has broken out so that the occupants can promptly escape from the story to another story within 30 sec. as set forth previously; and, thereafter, the closure means is actuated to shut tight the section by the control of the control panel and the suction means is actuated by the operation of the electromagnetic valves while the injecting nozzles are actuated by the electromagnetic valves, all controlled by the control panel upon receipt of a signal from the detecting means.

When liquefied nitrogen is used, the temperature in the section is rapidly lowered below the flashing point of combustibles in the section by the latent heat of gasification of the liquefied nitrogen while the atmosphere is rapidly made short of oxygen to positively and promptly extinguish the fire in the section. After removal of the atmosphere from the section upon extinguishing of the fire, no damage is inflicted on articles in the section because no harmful effect is given to the articles by nitrogen.

The evacuation of flame, smoke and air by the suction means at the floor of the section serves to enhance effective and uniform distribution of atomized fire extinguishing agent injected from the nozzles.

When foamable fire extinguishing liquid is used, a noncombustible coating is formed over combustibles in the section to positively prevent the same from being burnt and positively extinguish the fire.

The liquefied nitrogen and the foamable fire extinguishing liquid can be used separately or together.

After complete extinguishing of the fire, the atmosphere in the section is exhausted by the suction means, and fresh open air is introduced in the section so as to restore the normal condition of the atmosphere.

Since the warning is issued only to the story including the section in which fire has broken out, the panicky state of the occupants in other stories is positively prevented.

Each of the suction ducts may be provided with a cooling box in order to prevent overheating of the ducts.

Manual control panels may be provided for every three stories, for example, in addition to the automatic overall control panel so that a guard can manually operate the control panel when he detects the occurrence of fire so as to quickly extinguish the fire.

Figure 2:
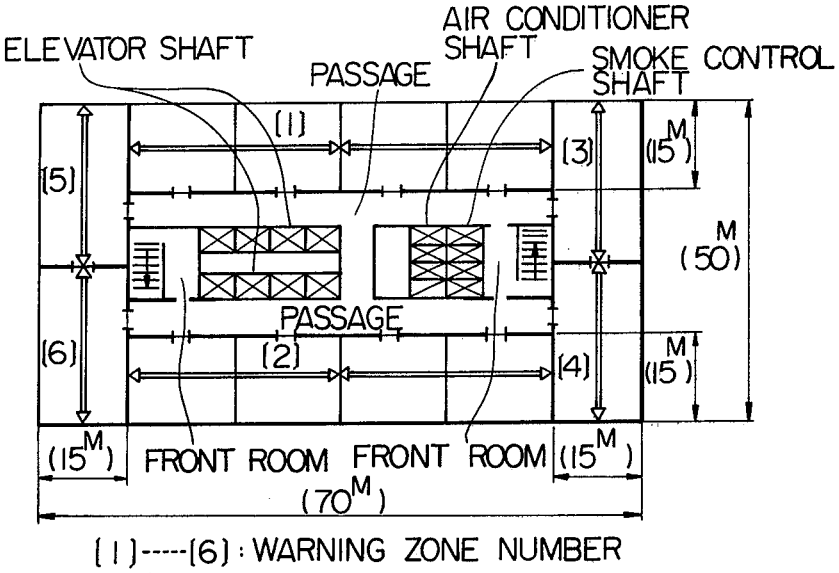
FIG. 2 is a schematic view showing an example of a warning section in each story of a skyscraper in accordance with the present invention.

FIG. 2 shows an example of the arrangement of the warning zone of FIG. 1. The size of the warning zones must be such as to insure that the occupants escape from the section within 30 sec. and before the section is shut tight, exemplary dimensions being set forth in FIG. 2.

Figure 3:
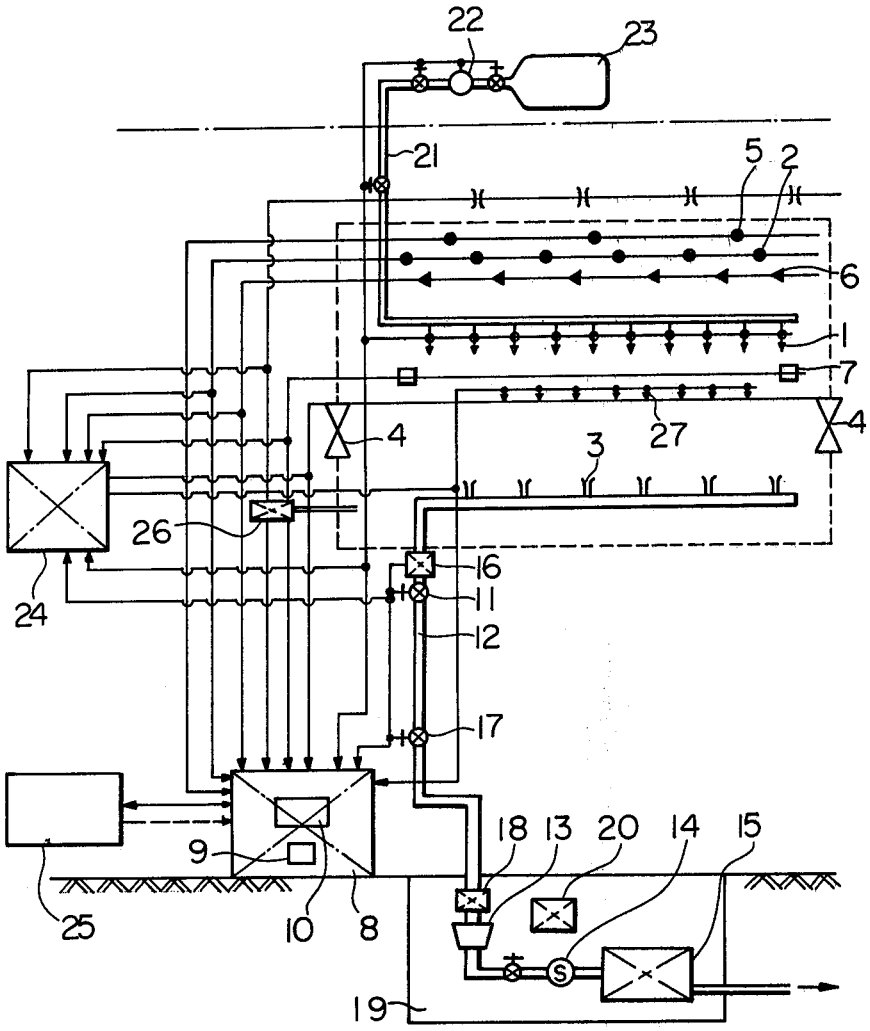
FIG. 3 is a view showing a circuit diagram of an embodiment of a fire extinguishing system in accordance with the present invention.

FIG. 3 shows an examplary arrangement of the fire extinguishing system of the present invention. The portion encircled by the broken line shows the concentrated fire fighting section in each story of the building. Injecting nozzles 1 and sensing means 2 are disposed in the upper portion, i.e., in the ceiling of the section, while bellmouthed suction funnels 3 are disposed in the floor of the section and the closure means, i.e., fire walls 4 are provided in each section.

Safety lamps 5 and indicating lamps 6 for occupants are also provided while televisions 7 are provided in order to watch the escape of occupants at the control station.

As previously described, the signal from the sensing means 2 is supplied to an overall control station 8 which signal enables a computer 9 in the station 8 to effect programming of sequential fire fighting operations, and overall control panel 10 actuates the successive operations of the various means described above in timed sequence after ascertaining that the occupants have escaped with 30 sec. after the occurrence of a fire.

In order words, the closure means or the fire prevention doors 4 are closed approximately 3 sec. after the above set time of 30 sec.; and, succesively, an electromagnetic valve 11 for a suction duct 12 is opened so as to evacuate the flame, smoke and air in the section by the action of suction pump 14 from bellmouthed funnels 3 through suction duct 12, and a dust collector 13 ot a noxious gas neutralizing reservoir 15 and exhausted to the atmosphere from the reservoir. A main electromagnetic valve 17 for the suction ducts 12 is provided adjacent a cooling box 16, and a duct cooling device 18 is provided in the main suction duct adjacent the dust collector 13. A power room 19 including the dust collector 13, the suction pump 14 and the noxious gas neutralizing reservoir 15 is provided with an emergency generator 20 for supplying electric power in case a power interruption takes place.

A valve or supply pump 22 in a supply duct 21 for supplying fire extinguishing agent is actuated by the control panel 10 under control of the computer 9 so that the fire extinguising agent is supplied from a reservoir 23 or a generator thereof through the duct 21 to the nozzles 1.

Manual operator panels 24 provided every three stories, for example, are connected in parallel to the control panel 10 thereby permitting manual control by a guard in the building.

The overall central station 8 is connected to a firehouse or fire station 25 thereby permitting required information to be mutually transmitted.

The circuits for connecting the various sensing, warning, suction and injection means to the control panel 10 are installed in fire proof material.

A safety detecting gas sampler 26 is provided so as to ascertain safety conditions in the sections after a fire has been extinguished.

The window glasses are of stationary type and air conditioning is to be effected. The glass is relatively weak against mechanical strain and heat; and, once the window glasses are broken when a fire occurs, a large quantity of exterior air is introduced in the section resulting in flash over. Therefore, an appropriate glass protecting means 27 is provided for each of the windows. The glass protecting means 27 may be a curtain or stream of inert gas, such as gaseous nitrogen.

As stated above, the present invention provides centralized fully automatic control effective for fighting fires in skyscrapers. In case the automatic control fails, the manual control panels can be utilized to manually operate the fire fighting equipment.

Figure 4A:
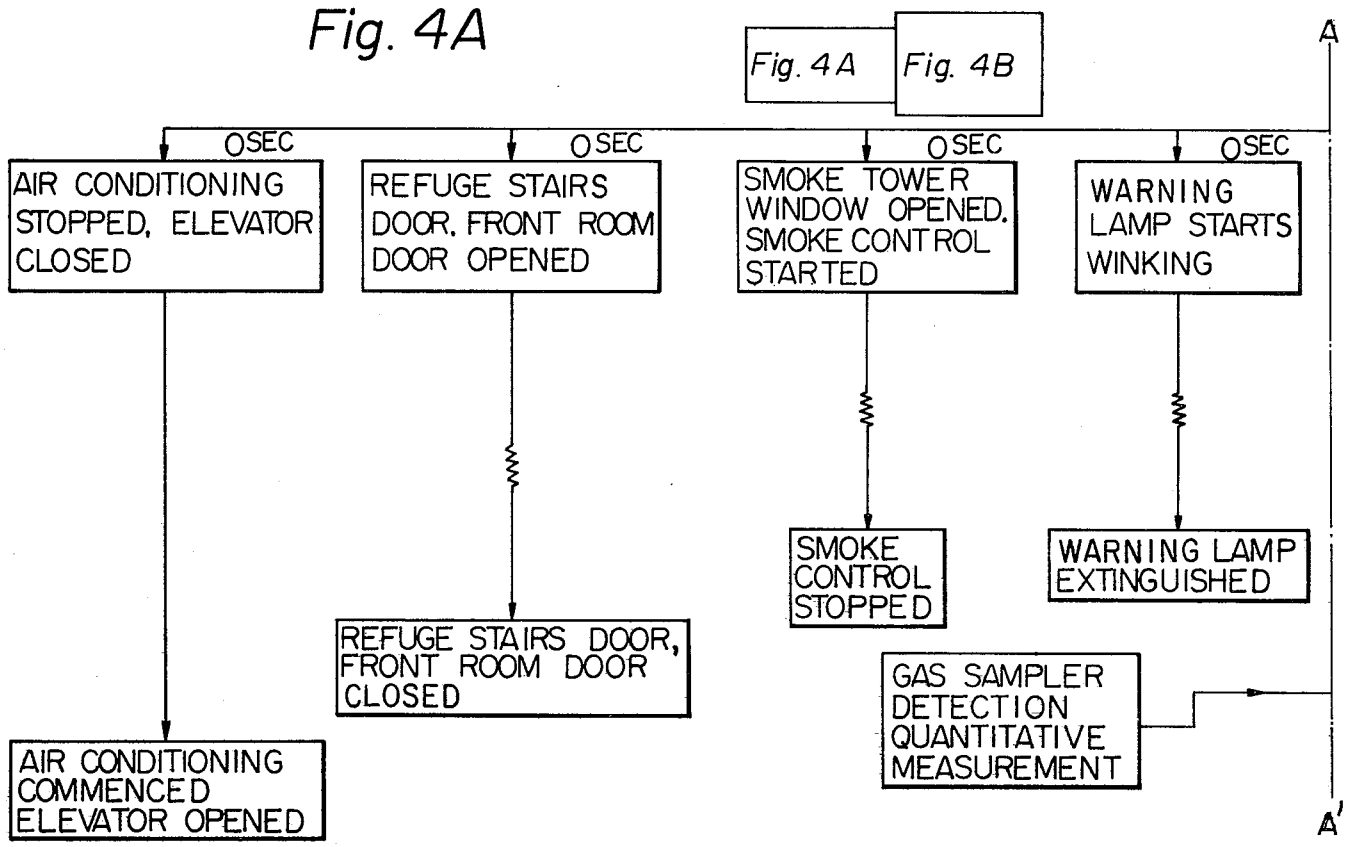
FIG. 4*a* is a flow diagram showing a portion of the operations of the method in accordance with the present invention.
Figure 4B:
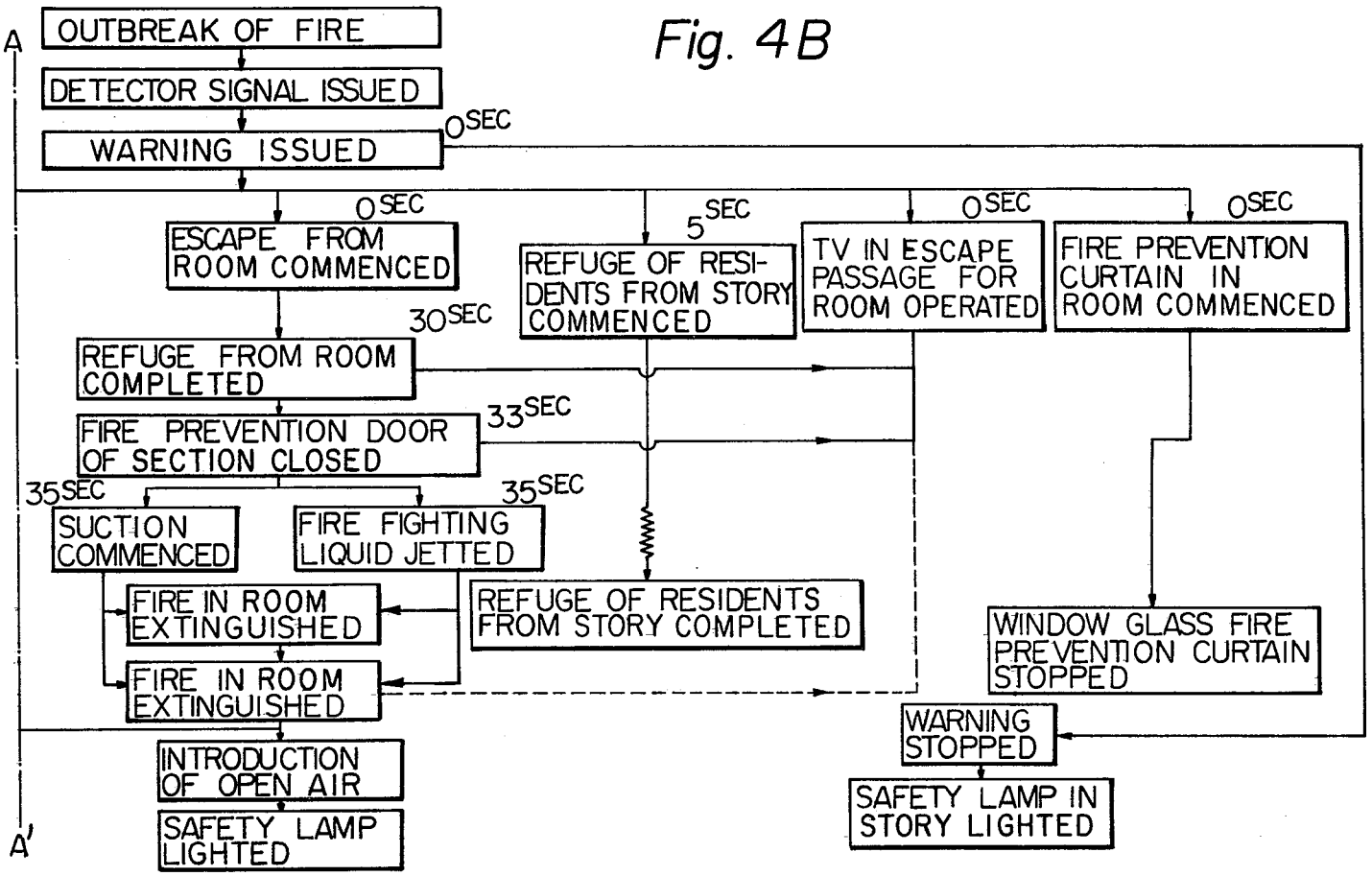
FIG. 4*b* is a flow diagram showing the remaining portion of the operations of the method in accordance with the present invention

FIGS. 4*a* and 4*b* are flow diagrams of operations to be carried out in accordance with the present invention.

Since the present invention utilizes liquefied nitrogen which is obtainable in large quantities at low cost and which is not harmful to human beings and articles while providing an excellent fire fighting effect, the present invention is very useful in the fighting of fires in skyscrapers.

I claim:

1. A mehtod for rapidly extinguishing fires in a building having a plurality of fire fighting sections therein each including closure means for isolating that section from the other sections comprising the steps of actuating the closure means in a fire fighting section in which a fire has broken out after occupants have escaped from the fire fighting section;

evacuating flame, smoke and air from the fire fighting section from a position adjacent the floor of the fire fighting section; and injecting a liquefied nitrogen fire extinguishing agent into the fire fighting section from a position adjacent the ceiling of the fire fighting section whereby the liquefied nitrogen fire extinguishing agent is evenly distributed throughout the fire fighting section and over articles in the fire fighting section due to the draw created by the evacuation from a position adjacent the floor of the fire fighting section causing the atmosphere within the fire fighting section to run short of oxygen while the temperature in the fire fighting section is promptly reduced below the flashing point of combustibles in the fire fighting section.

2. A method according to claim 1, further comprising the steps of completely evacuating residual noxious gases in the fire fighting section after the fire in the fire fighting section has been extinguished, and replacing the atmosphere within the fire fighting section with fresh air.

3. A method according to claim 1, wherein said step of evacuating flame, smoke and air is effected at a plurality of locations spaced from each other in the fire fighting section.

4. A mehtod according to claim 3, wherein said step of injecting a liquefied nitrogen fire extinguishing agent is effected at a plurality of locations spaced from each other in the fire fighting section.

5. A method according to claim 4, further comprising the steps of detecting occurrence of fire in any of the fire fighting sections issuing a warning upon detection of occurrence of fire only to the fire fighting section in which fire was detected, automatically effecting said step of actuating the closure means a predetermined time after detection of fire to provide time for occupant to escape from the fire fighting section, and automatically effecting said steps of evacuating flame, smoke and air and injecting a liquefied nitrogen fire extinguishing agent.

6. A system for rapidly extinguishing fires in a building having a plurality of fire fighting sections therein comprising closure means for isolating each of said fire fighting sections from the other fire fighting sections;

a plurality of suction means each disposed adjacent the floor in one of the fire fighting sections for evacuating flame, smoke and air therefrom;

a plurality of injecting means each disposed adjacent the ceiling in one of the fire fighting sections and including a plurality of injecting nozzles spaced from each other along the ceiling in each of the fire fighting sections for injecting a liquefied nitrogen fire extinguishing agent into the fire fighting section;

reservoir means for storing said liquefied nitrogen fire extinguishing agent and supplying said liquefied nitrogen fire extinguishing agent to said plurality of injecting means; and control means for operating said closure means to isolate a fire fighting section in which a fire has started and for operating said suction means and said injecting means in the fire fighting sections in which a fire has started whereby the fire is rapidly extinguished due to the draw of said suction means evenly distributing said liquefied nitrogen fire extinguishing agent throughout the fire fighting sections.

7. A system according to claim 6 wherein each of said suction means includes a plurality of bellmouthed funnel means spaced from each other along the floor in each of the fire fighting sections.

8. A system according to claim 6, further comprising a plurality of detecting means each disposed in one of the fire fighting sections for detecting fire therein, and a plurality of warning means each disposed in one of the fire fighting sections and responsive to detection of fire therein by said detecting means to provide a warning only in the fire fighting section in which fire was detected, said control means being responsive to a signal from any of said detecting means to automatically actuate said closure means to isolate the fire fighting section in which fire was detected a predetermined time after detection of the fire by said detecting means and automatically actuating said suction means and said injecting means in the fire fighting section in which fire was detected after actuation of said closure means.

9. A system according to claim 8, further comprising ventilation means for supplying fresh air to the fire fighting section in which fire was detected after the fire has been extinguished.

10. A system according to claim 9, wherein said control means includes computer means provided at a central control station in the building and said detecting means, said warning means, said suction means, said injecting means and said ventilation means are operably connected to said computer means thereby providing centralized control of said system.

* * * * *